US011268295B2

(12) United States Patent
Xu et al.

(10) Patent No.: US 11,268,295 B2
(45) Date of Patent: Mar. 8, 2022

(54) DOOR HANDLE SAFETY LOCK

(71) Applicant: NINGBO FABE CHILD SAFETY CO., LTD., Zhejiang (CN)

(72) Inventors: Jian Xu, Zhejiang (CN); Dong Li, Zhejiang (CN); Xinjun Wang, Zhejiang (CN)

(73) Assignee: NINGBO FABE CHILD SAFETY CO., LTD., Ningbo (CN)

( * ) Notice: Subject to any disclaimer, the term of this patent is extended or adjusted under 35 U.S.C. 154(b) by 219 days.

(21) Appl. No.: 16/571,097

(22) Filed: Sep. 14, 2019

(65) Prior Publication Data

US 2020/0354985 A1 Nov. 12, 2020

(30) Foreign Application Priority Data

May 8, 2019 (CN) ..... 201910377841.7

(51) Int. Cl.
*E05B 13/00* (2006.01)

(52) U.S. Cl.
CPC ..... *E05B 13/002* (2013.01)

(58) Field of Classification Search
CPC ..... E05B 13/002
See application file for complete search history.

(56) References Cited

U.S. PATENT DOCUMENTS

2006/0290148 A1* 12/2006 Talpe ..... E05B 13/005 292/336.3
2009/0056391 A1* 3/2009 Mathachan ..... E05B 13/002 70/91

* cited by examiner

*Primary Examiner* — Kristina R Fulton
*Assistant Examiner* — Thomas L Neubauer
(74) *Attorney, Agent, or Firm* — Global IP Services; Tianhua Gu

(57) ABSTRACT

A door handle safety lock comprises a button, a pedestal, a limited support arm and a spring, the outer wall the button is provided with retaining ribs; the top of the pedestal is provided with inserting parts, a first mounting hole matched with the button is arranged in the inserting part, and the first chutes are arranged on the inner wall of the first mounting hole; the end of the limited support arm which is close to the pedestal is provided with an inserting slot which is matched with the inserting part, the outer wall of the limited support arm which is close to the pedestal is provided with a second mounting hole which is matched with the button, and the second chute are arranged on the inner wall of the second mounting hole; and the spring is installed between the button and the hole bottom of the second mounting hole.

11 Claims, 7 Drawing Sheets

DOOR HANDLE SAFETY LOCK

TECHNICAL FIELD

The invention relates to the technical field of safety locks, in particular to a door handle safety lock.

BACKGROUND TECHNOLOGY

At present, most of the door locks in the market are opened centrifugally in a single direction. The door can be opened by rotating the door lock handle, and it is extremely convenient to use. However, for children at home, potential risks exist in such circumstances. With growth of the children, they are more and more curious about this world, and they may usually open doors and go out of the sight of adults. In order to prevent the children from open the room doors, the entrance doors, etc. at home, it is required to use door handle locks for protection, while most of various child locks in the market currently have the problems of a complex structure, too many parts and high cost.

INVENTION CONTENT

The invention aims to solve the problems existing in the prior art and provide a door handle safety lock which is simple in structure and convenient to operate. This safety lock can be used for locking the door lock handle and preventing the children from opening the room doors, the entrance doors, etc. to reduce potential risks. It has the characteristics of low cost, simple assembly process, high reliability, rapid installation and convenience in use.

In order to achieve the above mentioned purposes, the invention is realized through the following technical scheme:

A door handle safety lock, comprising:

A button (1), the outer wall on one end of the said button (1) is provided with retaining ribs (11);

A pedestal (2), the top of the said pedestal (2) is provided with inserting parts (21), a first mounting hole (22) which is matched with the button (1) is arranged in the said inserting part (21), and the first chutes (23) which are matched with the retaining ribs (11) are arranged on the inner wall of the first mounting hole (22);

A limited support arm (3), the end of the said limited support arm (3) which is close to the pedestal (3) is provided with an inserting slot (31) which is matched with the inserting part (21), the outer wall of the said limited support arm (3) which is close to the pedestal (2) is provided with a second mounting hole (32) which is matched with the button (1), the said second mounting hole (32) is communicated with the inserting slot (31), the center line of the said second mounting hole (32) is coincided with that of the first mounting hole (22), and the second chutes (33) which are matched with the retaining ribs (11) are arranged on the inner wall of the said second mounting hole (32);

A spring (4), the said spring (4) is installed between the button (1) and the hole bottom of the second mounting hole (32);

When the said button (1) is not pressed, a part of the said retaining ribs (11) are positioned in the first chutes (23), and the other part is positioned in the second chutes (33).

The said limited support arm (3) consists of the first support unit (34) and the second support unit (35) in a combined manner, the side of the said first support unit (34) which is away from the second support unit (35) is a flat bearing surface, and the said inserting slot (31) is positioned on the end side of the second support unit (35).

The said first support unit (34) and the second support unit (35) are cover bodies having cavities.

The said first support unit (34) is provided with inserting posts (36), and the said second support unit (35) is provided with inserting holes (37) which are matched with the inserting posts (36).

The bottom of the said pedestal (2) is provided with non-setting adhesive (24), and the said pedestal (2) is fixed onto the door body through the non-setting adhesive (24).

The outer wall of the said button (1) is provided with a snap (12), and the inner wall of the second mounting hole (32) is provided with a clamping slot (38) which is matched with the snap (12).

One end of the said button (1) is provided with an accommodating and mounting cavity (13) which is matched with the spring (4).

The said retaining ribs (11) comprise a first retaining rib (111) and a plurality of second retaining ribs (112), the width of the said first retaining rib (111) is greater than that of the second retaining rib (112), the quantity of the said first chutes (23) and the second chutes (33) is the same as that of the retaining ribs (11), a plurality of the said first chute (23) comprise three third chutes (231) which are matched with the first retaining ribs (111), the distance between the adjacent said third chutes (231) corresponds to one fourth of the circumference to the first mounting hole (22), and a plurality of the said second chutes (33) comprise a fourth chute (331) which is matched with the first retaining rib (111).

The quantity of the said inserting part (21) is two.

The outer wall of the button (1) which is close to one end of the retaining ribs (11) is provided with bosses (14), and the inner wall of the said first mounting hole (22) is provided in an array manner with a plurality of grooves (221) which are matched with the bosses (14).

Compared with the prior art, the invention has the beneficial effects that:

The safety lock in the invention is fixed onto the door body through the pedestal. When the safety lock in the invention is installed onto the door lock handle, the button is inserted into the second mounting hole and the first mounting hole, and the button is not pressed, the safety lock in the invention is in the locked state. A part of the retaining ribs are positioned in the first chutes, and the other part of the retaining ribs are positioned in the second chutes, which can prevent the limited support arm from rotating and lock the limited support arm onto the pedestal. The limited support arm provides limited support for the door lock handle, and it can limit the door lock handle and prevent the door lock handle from rotating to further prevent the door lock from opening; when pressing the button, the spring retracts, and all of the retaining ribs enter into the first chutes or enter into the second chutes. At this moment, the safety lock in the invention is in the unlocked state, the limited support arm can rotate around the button, the limited support arm can be toggled to the state which is away from the door lock handle, and when the limit state of the door lock handle is unlocked, the door lock can be opened smoothly. For the door lock which can be centrifugally opened in double directions, the safety lock in the invention are installed both on the upper and the lower sides of the door lock handle for limitation, so that the door lock handle can be locked to prevent the door lock from being opened accidentally. The safety lock in the invention can be operated by a single hand, and it is convenient to use. The locking of the door lock handle can be completed by means of the safety lock in the invention through coordination of the spring, the retaining ribs and two chutes. The structure is simple, the cost is low, and the reliability is high, it can be used for locking the door lock handle and preventing the children from opening the room doors, the entrance doors, etc. to reduce potential risks. It has the characteristics of simple assembly process, rapid installation and convenience in use.

Figure 1:
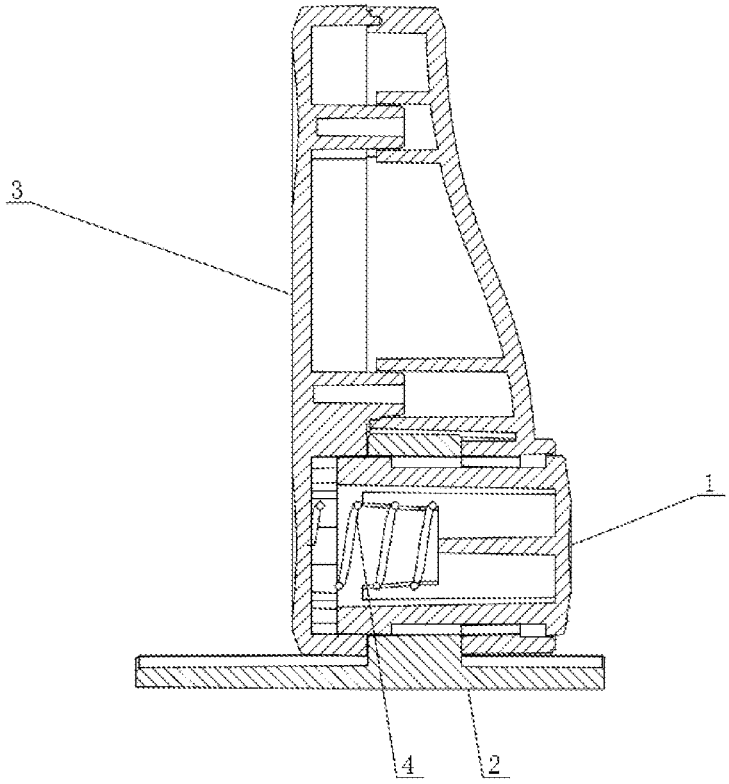
FIG. 1 is the structure schematic diagram of the invention.
Figure 2:
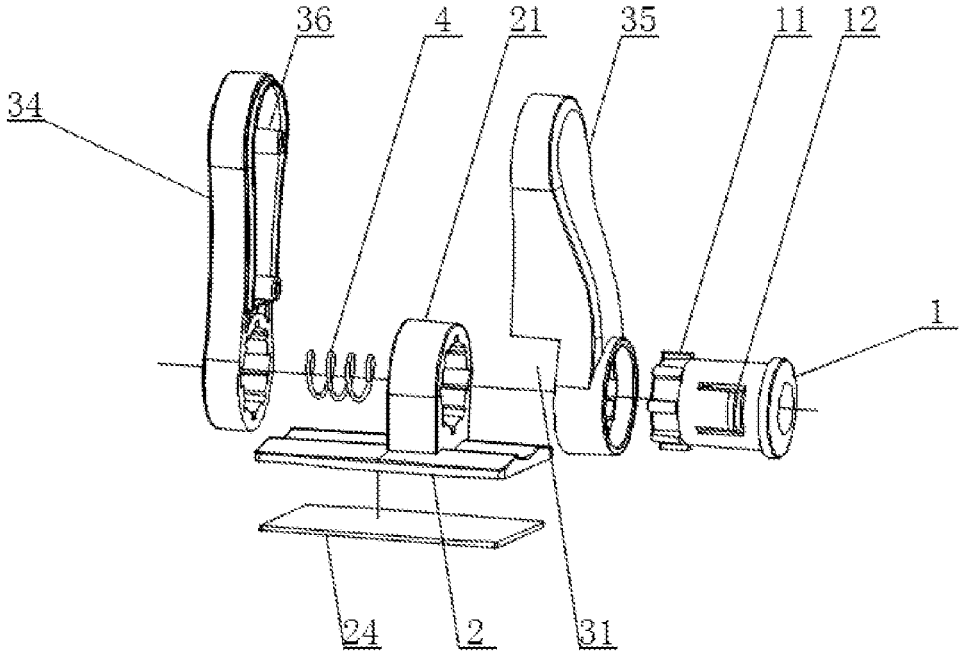
FIG. 2 is the first exploded view of the invention.
Figure 3:
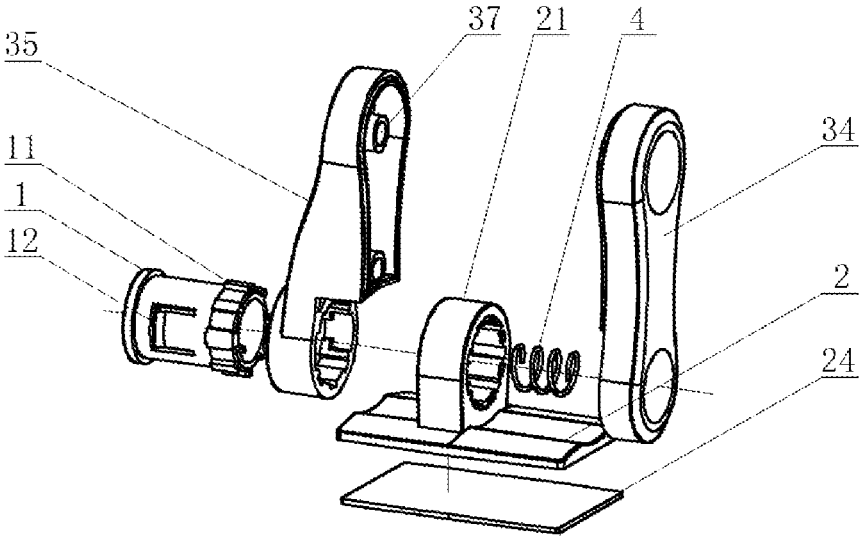
FIG. 3 is the second exploded view of the invention.
Figure 4:
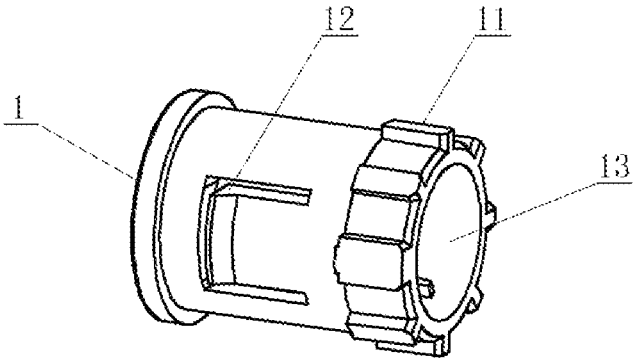
FIG. 4 is the structure schematic diagram of the button.
Figure 5:
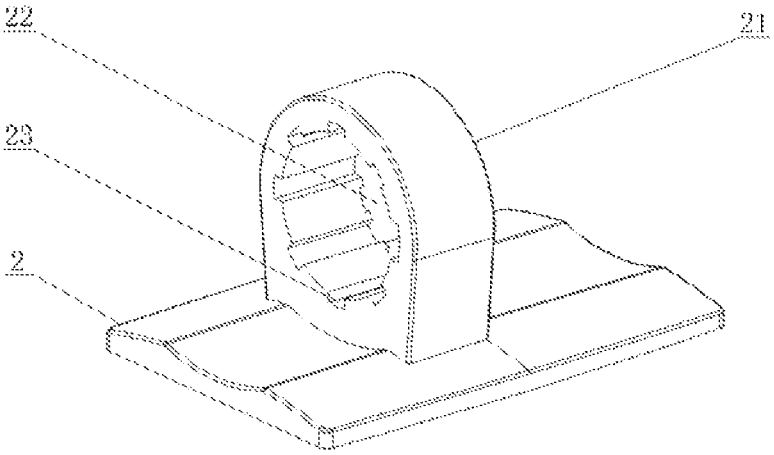
FIG. 5 is the structure schematic diagram of the pedestal.
Figure 6:
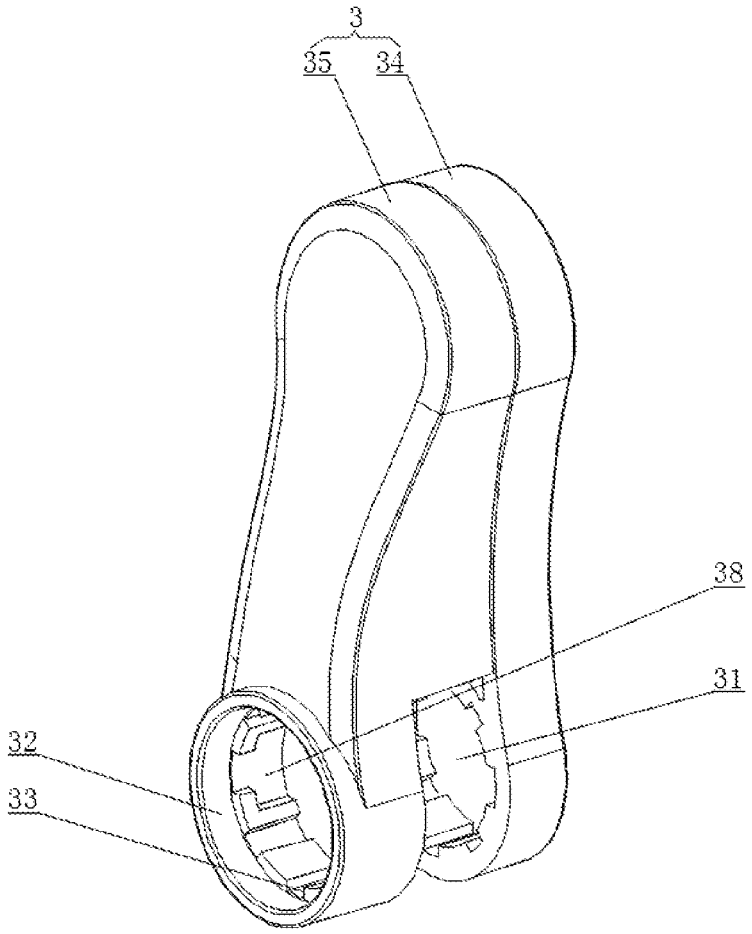
FIG. 6 is the structure schematic diagram of the limited support arm.
Figure 7:
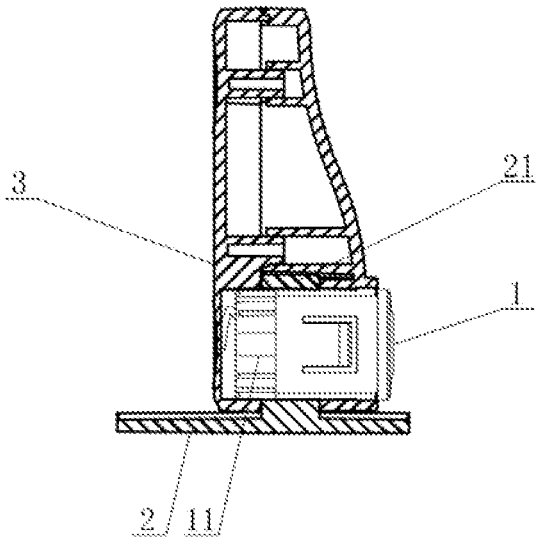
FIG. 7 is the schematic diagram of the invention in the locked state.
Figure 8:
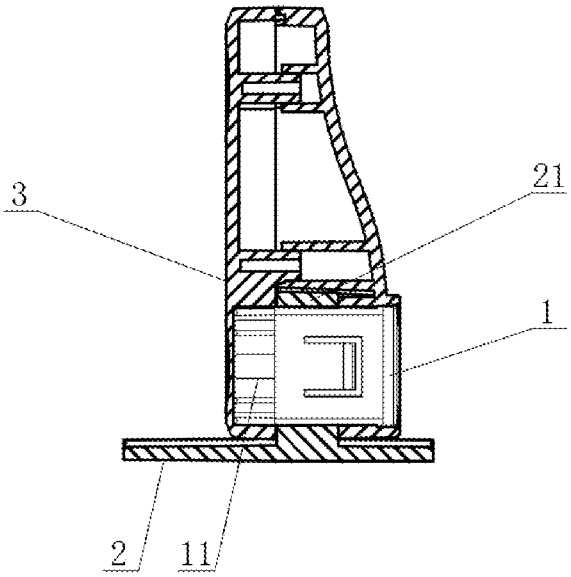
FIG. 8 is the schematic diagram of the invention in the unlocked state.
Figure 9:
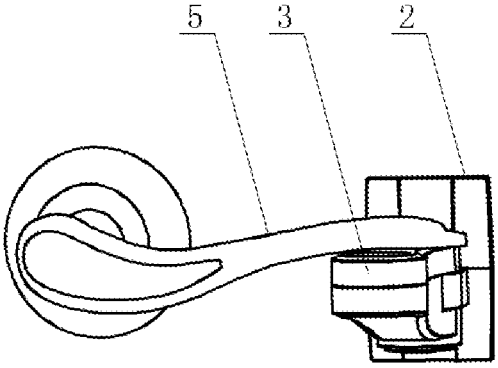
FIG. 9 is the schematic diagram of the door lock handle in the locked state.
Figure 10:
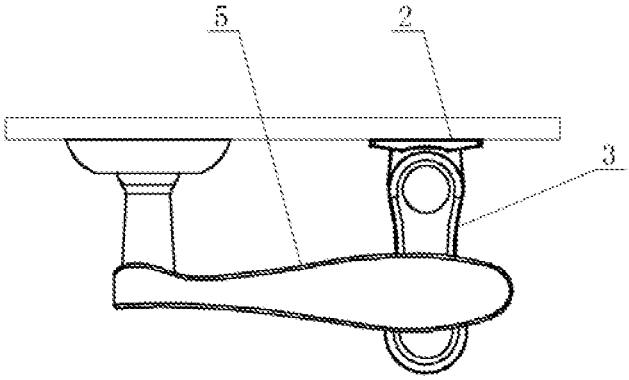
FIG. 10 is the top view of FIG. 9.
Figure 11:
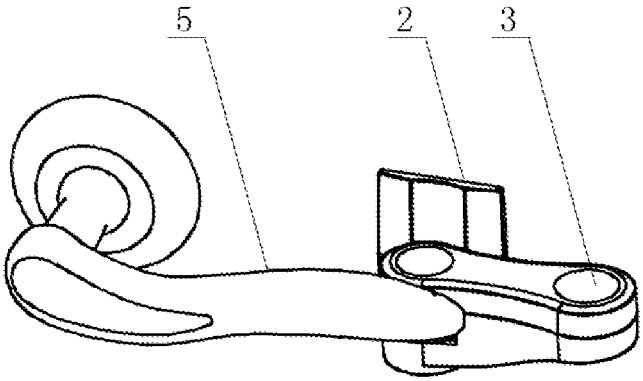
FIG. 11 is the schematic diagram of the door lock handle in the unlocked state.
Figure 12:
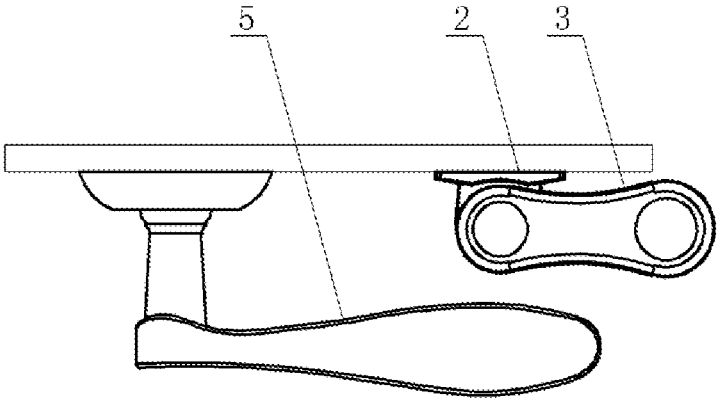
FIG. 12 is the top view of FIG. 11.
Figure 13:
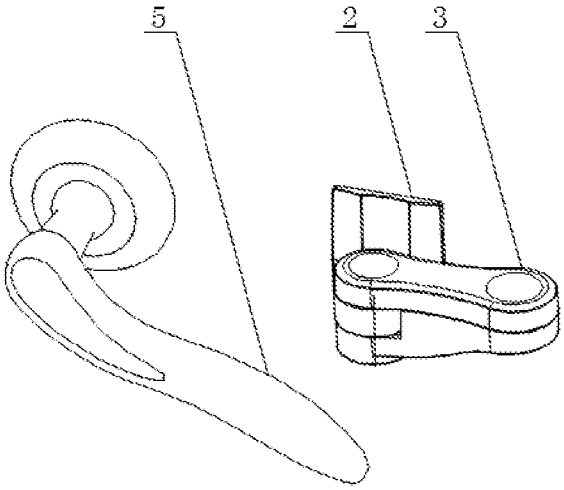
FIG. 13 is the schematic diagram of the door lock in the open state.
Figure 14:
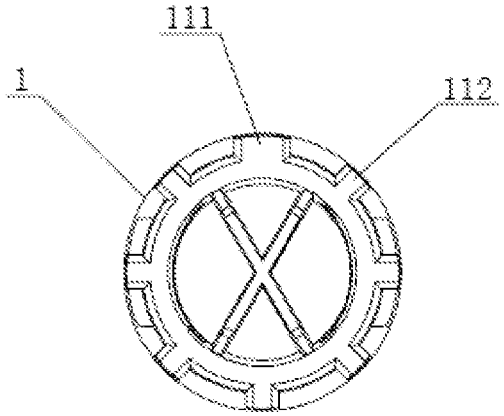
FIG. 14 is the structure schematic diagram of the button in Embodiment 3.
Figure 15:
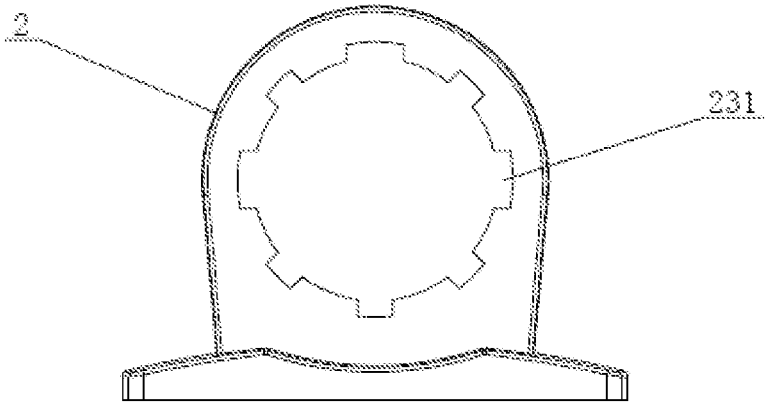
FIG. 15 is the structure schematic diagram of the pedestal in Embodiment 3.
Figure 16:
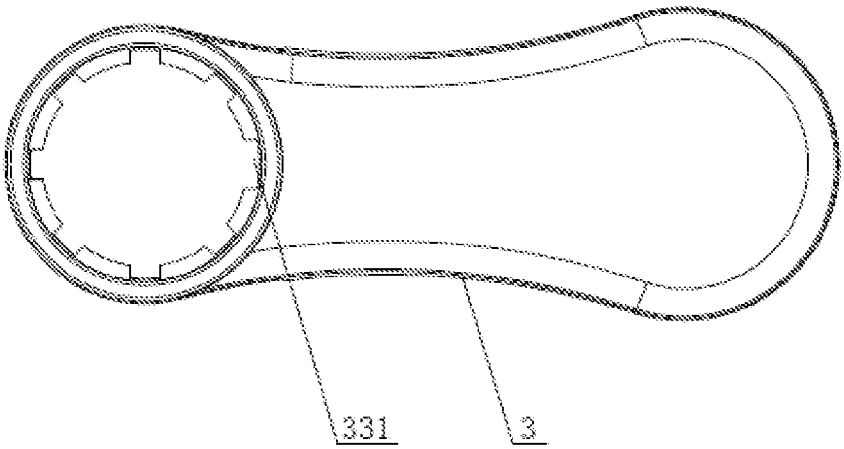
FIG. 16 is the structure schematic diagram of the limited support arm in Embodiment 3.
Figure 17:
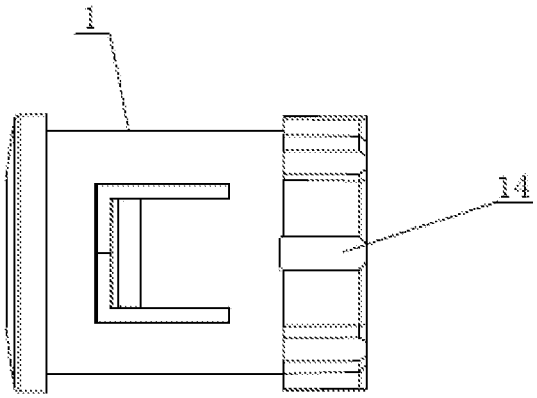
FIG. 17 is the structure schematic diagram of the boss in Embodiment 3.
Figure 18:
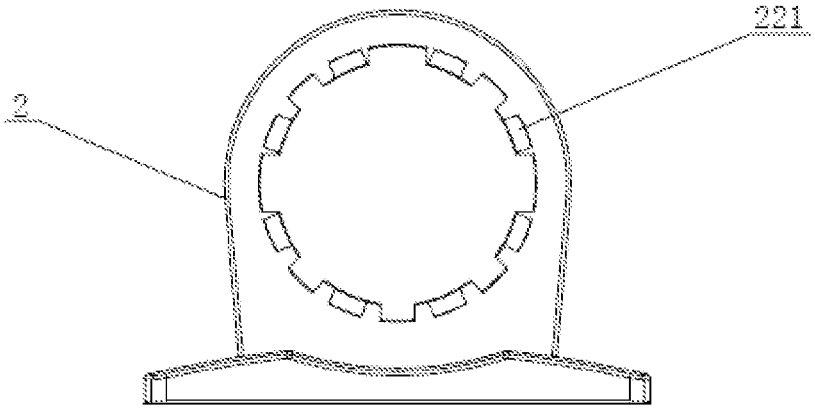
FIG. 18 is the structure schematic diagram of the groove in Embodiment 3.

Numbers in the figures: 1. Button; 11. retaining ribs; 111. the first retaining rib; 112. the second retaining rib; 12. Snap; 13. accommodating and mounting cavity; 14. boss; 2. pedestal; 21. inserting part; 22. the first mounting hole; 221. groove; 23. the first chute; 231. the third chute; 24. non-setting adhesive; 3. limited support arm; 31. inserting slot; 32. the second mounting hole; 33. the second chute; 331. the fourth chute; 34. the first support unit; 35. the second support unit; 36. inserting posts; 37. inserting holes; 38. clamping slot; 4. spring; and 5. door lock handle.

EMBODIMENTS

The door handle safety lock described in the invention comprises:

Button 1, the retaining ribs 11 are arranged on the outer wall on one end of the said button 1, and the retaining ribs 11 are arranged along the length direction of the button 1;

Pedestal 2, the pedestal 2 is used for fixing the safety lock of the invention on the door body, the top of the said pedestal 2 is provided with the inserting parts 21, the said inserting parts 21 are provided with the first mounting hole 22 which is matched with the button 1, the first chute 23 which is matched with the retaining ribs 11 is arranged on the inner wall of the first mounting hole 22, and the retaining ribs 11 can slide in the first chute 23. The button 1 can be inserted into the first mounting hole 22, and the button 1 can slide in the first mounting hole 22;

Limited support arm 3, the limited support arm 3 provides limitation for the door lock handle 5. It is used for preventing the door lock handle 5 from rotating to lock the door lock handle 5. The inserting slot 31 which is matched with the inserting parts 21 is arranged on the end which is close to the pedestal 2 of the said limited support arm 3. The second mounting hole 32 which is matched with the button 1 is arranged on the outer wall on the end of the said limited support arm which is close to the pedestal 2. The said mounting hole 32 is communicated with the inserting slot 31, and the center line of the said second mounting hole 32 is coincided with that of the first mounting hole 22. The second chute 33 which is matched with the retaining ribs 11 is arranged on the inner wall of the second mounting hole 32. The retaining ribs 11 can slide in the second chute 33, the button 1 can be inserted into the second mounting hole 32, and the button 1 can slide in the second mounting hole 32;

Spring 4, the said spring 4 is installed between the button 1 and the hole bottom of the second mounting hole 32; and the spring 4 provides outward thrust for the button 1. When the button 1 is not pressed, a part of the said retaining ribs 11 are positioned in the first chute 23, and the other part of the retaining ribs are positioned in the second chute 33.

The safety lock is fixed onto the door body through the pedestal 2, and the pedestal 2 is installed in the door lock handle 5 of the door body. The button 1 is inserted in the second mounting hole 32 and the first mounting hole 22. When the button 1 is not pressed, the safety lock of the invention is in the locked state, a part of the retaining ribs 11 are positioned in the first chute 23, and the other part of the retaining ribs are positioned in the second chute 33, which can prevent the limited support arm 3 from rotating to lock the limited support arm 3 onto the pedestal 2. The limited support arm 3 provides limited support for the door lock handle 5. It can limit the door lock handle 5 to prevent from the door lock handle 5 from rotating and further prevent the door lock 5 from opening; when the button 1 is pressed, the spring 4 retracts, all of the retaining ribs 11 enter into the first chute 23 or into the second chute 33, at this moment, the safety lock of the invention is in the locked state, and the limited support arm 3 can rotate around the button. When the limited support arm 3 is toggled away from the door lock handle 5, the limit state of the door lock handle 5 can be locked, and the door lock can be opened smoothly. For the door lock which can be opened centrifugally in both directions, the safety lock of the invention is installed on both upper and lower sides of the door lock handle 5 for limitation, and the door lock handle 5 can be locked to prevent from being opened accidentally. Furthermore, the safety lock of the invention can be operated with a single hand, and it is convenient to use. Through coordination of the spring 4, the retaining ribs 11 and two chutes, the locking of the door lock handle can be completed through the safety lock of the invention. It is simple in structure, low in cost and high in reliability, which can be used for locking the door lock handle, preventing the children from opening the room doors, the entrance doors, etc., so that potential risks can be reduced. It has the characteristics of simple assembly process, rapid installation and convenience in use.

In order to facilitate manufacturing of the limited support arm, the said limited support arm 3 consists of the first support unit 34 and the second support unit 35 in a combined manner. The side of the said first support unit 34 which is away from the second support unit 35 is a flat bearing surface, which can provide stable support for the door lock handle 5. The said inserting slot 31 is positioned on the side of the end part to the second support unit 35, which can facilitate the processing of the inserting slot 31 and the manufacturing of the limited support arm.

In order to reduce manufacturing cost of the limited support arm, the said first support unit 34 and the second support unit 35 are cover bodies with cavities, which can reduce manufacturing materials of the limited support arm and reduce the manufacturing cost of the limited support arm.

In order to facilitate assembly of the limited support arm, the said first support unit 34 is provided with inserting posts 36, and the said second support unit 35 is provided with the inserting holes 37 which are matched with the inserting posts 36. Align the inserting posts 36 on the first support unit 34 to the inserting holes 37 on the second support unit 35, then buckle the first support unit 34 and the second support unit 35, and weld both of them, the assembly of the limited support arm is completed, which can prevent the first support unit 34 and the second support unit 35 from being installed in an inclined manner.

In order to facilitate fixation of the safety lock in the invention, non-setting adhesive 24 is arranged in the bottom part of the said pedestal 2. The said pedestal 2 is fixed onto the door body through the non-setting adhesive, which can prevent from damaging the door body, so that the fixation of the safety lock in the invention is facilitated.

In order to facilitate installation of the button, the snap 12 is arranged on the outer wall of the button 1, and the clamping slot 38 which is matched with the snap 12 is arranged on the inner wall of the second mounting hole 32. Insert the button 1 into the second mounting hole 32, through coordination between the snap 12 and the clamping slot 38, the button 1 is locked in the second mounting hole 32 to prevent the button 1 from dropping, and the assembly is convenient and rapid.

In order to reduce the volume of the safety lock in the invention, one end of the said button 1 is provided with the accommodating and mounting cavity 13 which is matched with the spring 4, and a part of the spring 4 is positioned in the accommodating and mounting cavity 13, so that the volume of the safety lock in the invention can be reduced.

In order to avoid accidental locking, the said retaining ribs 11 comprise a first retaining rib 111 and a plurality of second retaining ribs 112. The width of the said first retaining rib 111 is greater than that of the second retaining rib 112. The quantity of the said first chute 23 and the second chute 33 is the same as that of the retaining ribs 11. The plurality of the said first chute 23 comprises three third chutes 231 which are matched with the first retaining rib 111. The distance between the adjacent said third chutes 231 corresponds to one fourth circumference of the first mounting hole 22. The plurality of the said second chute 33 comprises a fourth chute 331 which is matched with the first retaining rib 111. Only when the first retaining rib 111 enters the fourth chute 331 and one of the third chutes 231 simultaneously, the safety lock is in the locked state, and it can only be positioned at 90 degrees. The purpose of such a design is to prevent the children from being locked in the room caused by accidental locking of the safety lock.

In order to be suitable for the door lock which is opened centrifugally in double directions, the quantity of the said inserting parts 21 is two. Each inserting part 21 is installed with the limited support arm 3 and the button 1, wherein one of the limited support arms 3 is positioned on the upper side of the door lock handle 5, the other one is positioned on the lower side of the door lock handle 5, which can prevent the door lock handle 5 from rotating and locking the door lock which can be opened centrifugally in both directions.

In order to increase the using feel, the outer wall of the button 1 which is close to one end of the retaining ribs 11 is provided with bosses 14, and the inner wall of the said first mounting hole 22 is provided in an array manner with a plurality of grooves 221 which are matched with the bosses 14, and the bosses 14 are matched with the grooves 221, which can realize positioning during the rotating transition and increase the rotation feel.

Embodiment

Embodiment 1

The door handle safety lock described in the invention comprises:

Button 1, the retaining ribs 11 are arranged on the outer wall on one end of the said button 1, and the retaining ribs 11 are arranged along the length direction of the button 1. The quantity of the retaining ribs 11 is multiple. Through coordination of multiple retaining ribs 11, the locking is enabled to be more secure, and the locking effect can be increased.

Pedestal 2, the pedestal 2 is used for fixing the safety lock of the invention on the door body. Preferably, the bottom of the said pedestal 2 is provided with non-setting adhesive 24, the said pedestal 2 is fixed onto the door body through the non-setting adhesive 24, which can prevent from damaging the door body and facilitate fixation of the safety lock in the invention. The top of the said pedestal 2 is provided with inserting parts 21, and the inserting parts 21 and the pedestal 2 adopt the integrated structure. The said inserting parts 21 are provided with the first mounting hole 22 which is matched with the button 1, and the diameter of the second mounting hole 22 is slightly greater than the outer diameter of the button 1. The inner wall of the said first mounting hole 22 is provided with the first chute 23 which is matched with the retaining ribs 11, and the first chute 23 is arranged axially along the full length of the first mounting hole 22. The retaining ribs 11 can slide in the first chute 23, the button 1 can be inserted into the first mounting hole 22, and the button 1 can slide in the first mounting hole 22.

The snap 12 is arranged on the outer wall of the button 1, and the clamping slot 38 which is matched with the snap 12 is arranged on the inner wall of the second mounting hole 32. Insert the button 1 into the second mounting hole 32, through coordination between the snap 12 and the clamping slot 38, the button 1 is locked in the second mounting hole 32 to prevent the button 1 from dropping, and the assembly is convenient and rapid.

Limited support arm 3, the limited support arm 3 provides limitation for the door lock handle 5. It is used for preventing the door lock handle 5 from rotating to lock the door lock handle 5. The inserting slot 31 which is matched with the inserting parts 21 is arranged on the end which is close to the pedestal 2 of the said limited support arm 3. The second mounting hole 32 which is matched with the button 1 is arranged on the outer wall on the end of the said limited support arm which is close to the pedestal 2. The said mounting hole 32 is communicated with the inserting slot 31, and the center line of the said second mounting hole 32 is coincided with that of the first mounting hole 22. The second chute 33 which is matched with the retaining ribs 11 is arranged on the inner wall of the second mounting hole 32. The retaining ribs 11 can slide in the second chute 33, the button 1 can be inserted into the second mounting hole 32, and the button 1 can slide in the second mounting hole 32. The inserting slot 31 divides the second mounting hole 32 into the left part and the right part, and meanwhile it also divides the second chute 33 into the left part and the right part. The left length of the second chute 33 shall be greater than the length of the retaining ribs 11, so that it is ensured that when pressing the button 1, all the retaining ribs 11 enter the left part of the second chute 33. The said limited support arm 3 consists of the first support unit 34 and the second support unit 35 in a combined manner. The side of the first support unit 34 which is away from the second support unit 35 is a flat bearing surface. The flat bearing surface can provide stable support for the door lock handle 5. The said inserting slot 31 is positioned on the side on the end of the second support unit 35, which can facilitate the processing of the inserting slot 31 and the manufacturing of the limited support arm. Furthermore, the said first support unit 34 and the second support unit 35 are cover bodies with cavities, which can reduce manufacturing materials of the limited support arm and the manufacturing cost of the limited support arm. Preferably, the said first support unit 34 is provided with inserting posts 36, the said second support unit 35 is provided with the inserting holes 37 which are matched with the inserting posts 36. Align the inserting posts 36 on the first support unit 34 to the inserting holes 37 on the second support unit 35, then buckle the first support unit 34 and the second support unit 35, and weld both of them, the assembly of the limited support arm is completed, which can prevent the first support unit 34 and the second support unit 35 from being installed in an inclined manner.

Spring 4, the said spring 4 is installed between the button 1 and the hole bottom of the second mounting hole 32, and one end of the button 1 is provided with the accommodating and mounting cavity 13 which is matched with the spring 4. Apart of the spring 4 is positioned in the accommodating and mounting cavity 13, so that the volume of the safety lock in the invention can be reduced. The spring 4 provides outward thrust for the button 1. When the button 1 is not pressed, a part of the said retaining ribs 11 are positioned in the first chute 23, and the other part of the retaining ribs are positioned in the second chute 33.

The assembly method and steps of the invention are as below:

Step 1: Carry out the assembly of the limited support arm 3. Buckle the first support unit 34 and the second support unit 35. Use ultrasonic welding equipment to weld it and form the limited support arm 3 (the first support unit 34 and the second support unit 35 can also be fixed together through screws and glue);

Step 2: Clamp the spring 4 into the button 1 to finish the assembly of the button 1;

Step 3: Insert the inserting parts 21 on the pedestal 2 into the inserting slot 31 of the limited support arm 3;

Step 4: Axially thrust the button 1 into the second mounting hole 32 on the limited support arm 3. The button 1 sequentially passes through the right part of the second mounting hole 32, the first mounting hole 22, and the left part of the second mounting hole 32. The button 1 is locked into the second mounting hole 32 through coordination between the snap 12 and the clamping slot 38;

Step 5: Paste the non-setting adhesive 24 onto the bottom of the pedestal 2.

The safety lock is fixed onto the door body through the pedestal 2, and the pedestal 2 is installed in the door lock handle 5 of the door body. The button 1 is inserted in the second mounting hole 32 and the first mounting hole 22. When the button 1 is not pressed, the safety lock of the invention is in the locked state, a part of the retaining ribs 11 are positioned in the first chute 23, and the other part of the retaining ribs are positioned in the second chute 33, which can prevent the limited support arm 3 from rotating to lock the limited support arm 3 onto the pedestal 2. The limited support arm 3 provides limited support for the door lock handle 5. It can limit the door lock handle 5 to prevent from the door lock handle 5 from rotating and further prevent the door lock 5 from opening; when the button 1 is pressed, the spring 4 retracts, all of the retaining ribs 11 enter into the left part of the second chute 33, at this moment, the safety lock of the invention is in the locked state, and the limited support arm 3 can rotate around the button. When the limited support arm 3 is toggled away from the door lock handle 5, the limit state of the door lock handle 5 can be locked, and the door lock can be opened smoothly. For the door lock which can be opened centrifugally in both directions, the safety lock of the invention is installed on both upper and lower sides of the door lock handle 5 for limitation, and the door lock handle 5 can be locked to prevent from being opened accidentally. Furthermore, the safety lock of the invention can be operated with a single hand, and it is convenient to use. Through coordination of the spring 4, the retaining ribs 11 and two chutes, the locking of the door lock handle can be completed through the safety lock of the invention. It is simple in structure, low in cost and high in reliability, which can be used for locking the door lock handle, preventing the children from opening the room doors, the entrance doors, etc., so that potential risks can be reduced. It has the characteristics of simple assembly process, rapid installation and convenience in use.

Embodiment 2

Except for the quantity of the inserting parts 21, this embodiment is same as the Embodiment 1. In order to be suitable for the door lock which is opened centrifugally in both directions, the quantity of the said inserting parts 21 is two, each inserting part 21 is installed with the limited support arm 3 and the button 1, wherein one of the limited support arms 3 is positioned on the upper side of the door lock handle 5, and the other one is positioned on the lower side of the door lock handle 5, so that the rotation of the door lock handle 5 can be avoided, and the door lock which is opened centrifugally in both directions can be locked.

Embodiment 3

On the basis of the Embodiment 1, the retaining ribs 11 are divided into two types with different sizes. The said retaining ribs 11 comprise a first retaining rib 111 and a plurality of second retaining ribs 112. The width of the said first retaining rib 111 is greater than that of the second retaining rib 112. The quantity of the said first chute 23 and the second chute 33 is the same as that of the retaining ribs 11. The plurality of the said first chute 23 comprises three third chutes 231 which are matched with the first retaining rib 111. The distance between the adjacent said third chutes 231 corresponds to one fourth circumference of the first mounting hole 22. The plurality of the said second chute 33 comprises a fourth chute 331 which is matched with the first retaining rib 111. Only when the first retaining rib 111 enters the fourth chute 331 and one of the third chutes 231 simultaneously, the safety lock is in the locked state, and it can only be positioned at 90 degrees. The purpose of such a design is to prevent the children from being locked in the room caused by accidental locking of the safety lock. Meanwhile, a boss 14 can also be set on the outer wall on the end of the button 1 which is close to the retaining ribs 11, and the inner wall of the said first mounting hole 22 is provided in an array manner with a plurality of grooves 221 which are matched with the bosses 14, and the bosses 14 are matched with the grooves 221, which can realize positioning during the rotating transition and increase the rotation feel.

What is claimed is:

1. A door handle safety lock, comprising:

A button (1), the outer wall on one end of the said button (1) is provided with retaining ribs (11);

A pedestal (2), the top of the said pedestal (2) is provided with inserting parts (21), a first mounting hole (22) which is matched with the button (1) is arranged in the said inserting part (21), and the first chutes (23) which are matched with the retaining ribs (11) are arranged on the inner wall of the first mounting hole (22);

A limited support arm (3), the end of the said limited support arm (3) which is close to the pedestal (3) is provided with an inserting slot (31) which is matched with the inserting part (21), the outer wall of the said limited support arm (3) which is close to the pedestal (2) is provided with a second mounting hole (32) which is matched with the button (1), the said second mounting hole (32) is communicated with the inserting slot (31), the center line of the said second mounting hole (32) is coincided with that of the first mounting hole (22), and the second chutes (33) which are matched with the retaining ribs (11) are arranged on the inner wall of the said second mounting hole (32);

A spring (4), the said spring (4) is installed between the button (1) and the hole bottom of the second mounting hole (32);

When the said button (1) is not pressed, a part of the said retaining ribs (11) are positioned in the first chutes (23), and the other part is positioned in the second chutes (33).

2. The door handle safety lock according to claim 1, the said limited support arm (3) consists of the first support unit (34) and the second support unit (35) in a combined manner, the side of the said first support unit (34) which is away from the second support unit (35) is a flat bearing surface, and the said inserting slot (31) is positioned on the end side of the second support unit (35).

3. The door handle safety lock according to claim 2, the said first support unit (34) and the second support unit (35) are cover bodies having cavities.

4. The door handle safety lock according to claim 2, the said first support unit (34) is provided with inserting posts (36), and the said second support unit (35) is provided with inserting holes (37) which are matched with the inserting posts (36).

5. The door handle safety lock according to claim 3, the said first support unit (34) is provided with inserting posts (36), and the said second support unit (35) is provided with inserting holes (37) which are matched with the inserting posts (36).

6. The door handle safety lock according to claim 1, the bottom of the said pedestal (2) is provided with non-setting adhesive (24), and the said pedestal (2) is fixed onto the door body through the non-setting adhesive (24).

7. The door handle safety lock according to claim 1, the outer wall of the said button (1) is provided with a snap (12), and the inner wall of the second mounting hole (32) is provided with a clamping slot (38) which is matched with the snap (12).

8. The door handle safety lock according to claim 1, one end of the said button (1) is provided with an accommodating and mounting cavity (13) which is matched with the spring (4).

9. The door handle safety lock according to claim 1, the said retaining ribs (11) comprise a first retaining rib (111) and a plurality of second retaining ribs (112), the width of the said first retaining rib (111) is greater than that of the second retaining rib (112), the quantity of the said first chutes (23) and the second chutes (33) is the same as that of the retaining ribs (11), a plurality of the said first chute (23) comprise three third chutes (231) which are matched with the first retaining ribs (111), the distance between the adjacent said third chutes (231) corresponds to one fourth of the circumference to the first mounting hole (22), and a plurality of the said second chutes (33) comprise a fourth chute (331) which is matched with the first retaining rib (111).

10. The door handle safety lock according to claim 1, the quantity of the said inserting part (21) is two.

11. The door handle safety lock according to claim 1, the outer wall of the button (1) which is close to one end of the retaining ribs (11) is provided with bosses (14), and the inner wall of the said first mounting hole (22) is provided in an array manner with a plurality of grooves (221) which are matched with the bosses (14).

* * * * *